US006557259B1

(12) United States Patent
Nguyen

(10) Patent No.: US 6,557,259 B1
(45) Date of Patent: May 6, 2003

(54) UNIFORM ARTIFICIAL NAIL CLIPPER

(76) Inventor: Thanh Nguyen, 4225 8th Ave., #B, Sacramento, CA (US) 95817

( * ) Notice: Subject to any disclaimer, the term of this patent is extended or adjusted under 35 U.S.C. 154(b) by 167 days.

(21) Appl. No.: 09/636,649

(22) Filed: Aug. 1, 2000

(51) Int. Cl.[7] ..... A45D 29/02
(52) U.S. Cl. ..... 30/29; 132/75.5; 30/243
(58) Field of Search ..... 30/29, 28, 27, 30/241–244, 261, 262; 132/75.5, 73.5, 75.3, 75.4

(56) References Cited

U.S. PATENT DOCUMENTS

| | | | | | |
|---|---|---|---|---|---|
| 3,838,507 | A | * | 10/1974 | Clark | 30/29 |
| 4,856,190 | A | * | 8/1989 | Reiswig | 30/29 |
| 5,557,849 | A | * | 9/1996 | Lee et al. | 30/29 |
| 5,640,770 | A | * | 6/1997 | Fowler | 30/29 |
| 5,727,318 | A | * | 3/1998 | Reiswig | 30/29 |
| 5,918,375 | A | * | 7/1999 | Rossi, III | 33/485 |

* cited by examiner

*Primary Examiner*—Kenneth E. Peterson
*Assistant Examiner*—Omar Flores Sánchez
(74) *Attorney, Agent, or Firm*—Mark C. Jacobs

(57) ABSTRACT

A nail clipper of this invention has a somewhat V-shaped handle portion formed of a first upper handle and a second lower handle each of which is pivotally mounted with respect to the other, and movable toward the other. A nail holder, having an arcuate slot for the receipt of an artificial nail, extends forwardly from the lower handle. A cutter assembly having a forwardly disposed arcuate blade edge, is slidably mounted and interconnected to the upper handle's movement whereby it is actuated forwardly over the nail holder to carry out a cutting motion against a nail disposed in the nail holder's slot, upon the application of force to the two handles and moved rearwardly by a release of the grip of the upper portion. The apparatus also includes an elevation setter which may be used for controlling the size of cut of a nail inserted into the nail holder slot. A sizing tool may be employed with the elevation setter to preset the length of the nail to be worn.

18 Claims, 6 Drawing Sheets

Fig. 10A
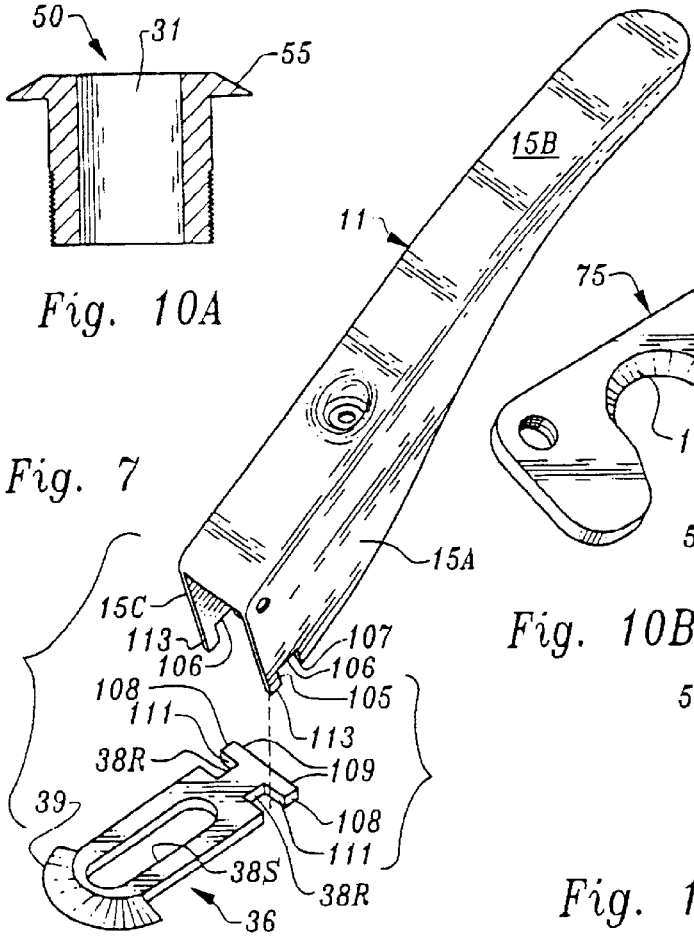
Fig. 7
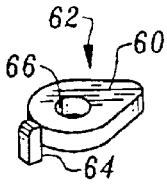
Fig. 9
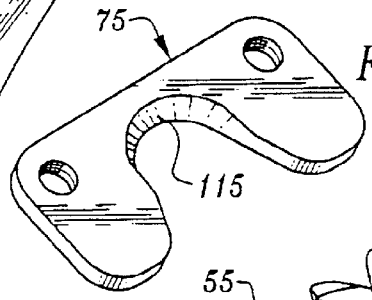
Fig. 8
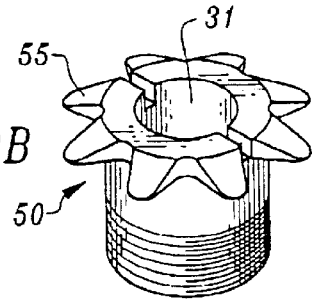
Fig. 10B
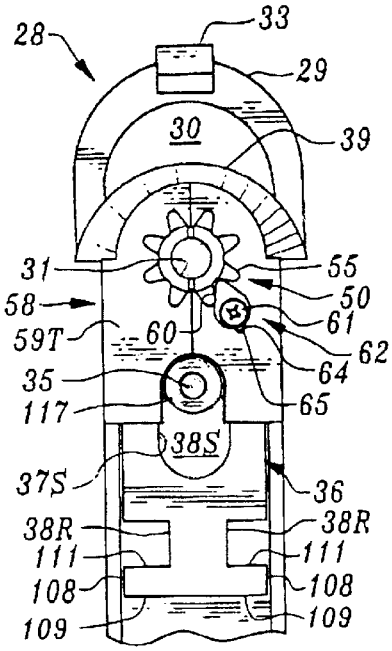
Fig. 11
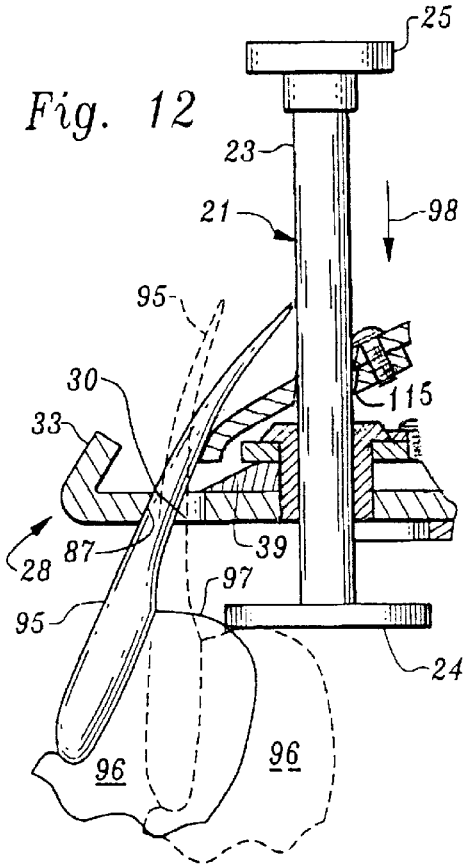
Fig. 12

11
12
17
37
43
112
108
107
109
106
38R
113
111
105
51
35
18
117
63
64
61
115
62
27
25
21
23
16
19
50
36
39
33
28
30
31
24

39
38
36
38R
108
109
38S
37S
111
44A
44B
32
20W
34
48
77
29

UNIFORM ARTIFICIAL NAIL CLIPPER

FIELD OF THE INVENTION

This invention pertains to an apparatus for trimming and shaping artificial nails to any length as may be desired by the wearer of the nails.

BACKGROUND OF THE INVENTION

This invention relates generally to fingernail apparatuses, particularly to those of the clipper designation, which are used for the cutting of both artificial and natural nails.

Since the main purpose of this apparatus is for cutting artificial nails most of the discussion will pertain to that topic.

Artificial nails are pre-formed elongated plastic materials usually of an acrylic material or of fiberglass and are attached to the natural nail through a suitable cement. They are then clipped to the desired length with cuts across the body of the artificial nail structure such as by the use of this invention.

As is known in the art artificial nails are mounted in place by attaching the natural nail to the artificial nail's underside using any known suitable cement. The artificial nails once mounted are clipped or trimmed to a desired length and shape. The clipping that takes place calls for one or more lateral cuts to be made from front to back or from back to front through the thickness of the nail. The rough edge is then filed into a smooth continuous curvature and then buffed.

One of the problems that arises in nail trimming is the difficulty in achieving uniform length in a set of nails. That problem can be overcome with the use of the apparatus of this invention, for the trimming of the totality of ten nails, all to a same even size such as to closely approach the look of natural fingernails.

Apparatuses to trim artificial nails are not new to the art. Thus I refer to U.S. Pat. No. 505,513 and U.S. Pat. No. 5,727,318 both issued to Gary J. Reiswig of Tigard Oreg. 97224. In both of these, a pivotable member causes a cutting blade to slide forward is employed to effect the cutting of the nail.

Other attempts have been made over the years to trim artificial nails. Sometimes persons have attempted to adapt nail clippers for natural nails to be utilized for the trimming of artificial nails. While cutting may transpire, it is generally recognized that such apparatuses are not deemed acceptable to those who practice the art of the application of artificial nails for a living.

Thus, in addition to those recited above, applicant is familiar with the following U.S. patents:

| | | |
|---|---|---|
| 5,123,430 | June 23, 1992 | Davidovitz |
| 5,557,849 | September 24, 1996 | Lee et al |
| 5,101,563 | April 7, 1992 | d'Orgelys |
| 4,856,190 | August 15, 1999 | Reiswig |
| 5,533,262 | July 9, 1996 | Clark |
| 5,622,191 | April 22, 1997 | McMullen et al |
| 5,640,770 | June 24, 1997 | Fowler |

None of the patents referenced, anticipates or renders the invention of this patent application obvious to one of ordinary skill.

In addition to the cutting apparatus of this invention, there is also provided as an aspect hereto, a sizing tool, having numbers thereon, for use in conjunction with the apparatus of this invention to set a desired size of the length of nails to be worn.

It is one object of this invention to provide an adjustable nail trimming and shaping apparatus.

It is another object to provide a cutting and shaping nail apparatus that is easily disassembled for cleaning.

It is yet another object to provide a nail trimming and shaping apparatus that is easy to use and is relatively low in cost.

It is a specific object of this invention to provide a device that improves over the Reiswig apparatuses that are currently available in the marketplace.

It is a further object to provide a nail clipper which can be used to cut the totality of 10 nails, all to the same even size and shape.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

BRIEF DESCRIPTION OF THE FIGURES

FIG. 7 is a perspective view of two components of this invention.

FIG. 8 is a top perspective view of the reinforcement plate forming an element of this invention.

FIG. 9 is a top perspective view of the gear lock washer employed herein.;

FIG. 10A is a sectional view of the reinforcing annulus bolt utilized herein.

FIG. 10B is a top perspective view of the bolt of FIG. 10A.

FIG. 11 is a top plan view of the cutting portion of this invention.

FIG. 12 is a partial sectional view of the apparatus, showing a nail placed in the apparatus and prior to a nail cut transpiring.

SUMMARY OF THE INVENTION

The nail clipper of this invention has a somewhat V-shaped handle portion formed of a first upper handle and a second lower handle each of which is movable toward the other member by the application of force and away from each other by the expansion of a coil spring disposed between the upper and lower handles. A nail holder, having an arcuate slot for the receipt of an artificial nail, extends forwardly from the lower handle. A blade having a forwardly disposed arcuate cutting edge, disposed above said nail holder, is slidably mounted and interconnected to the upper handle whereby upon the application of a downward force to the upper handle, a forward motion is applied to the cutter assembly containing said blade, by means attached to said upper handle to carry out a cutting motion against a nail disposed in the slot.

An elevation setter disposed through the nail holder, which can be moved upwardly and downwardly, is used to control the length of the cut of the nail disposed in the nail holder. A sizing tool for use in conjunction with the elevation setter for pre-setting a specifically desired length of cut of a nail cut also forms part of this invention.

DESCRIPTION OF THE PREFERRED EMBODIMENT

Figure 5:
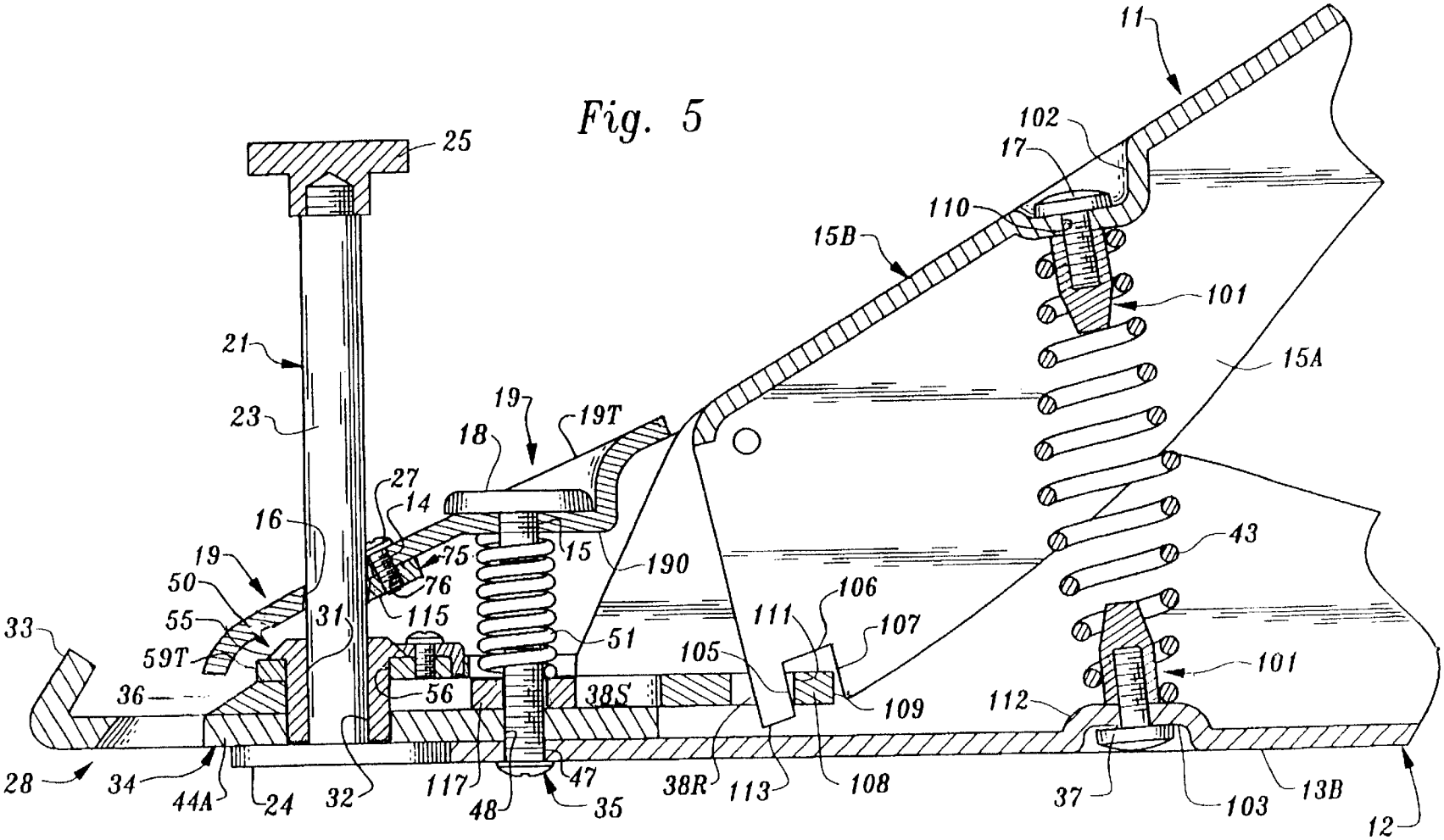
FIG. 5 is a sectional view of the apparatus of this invention.
Figure 17:
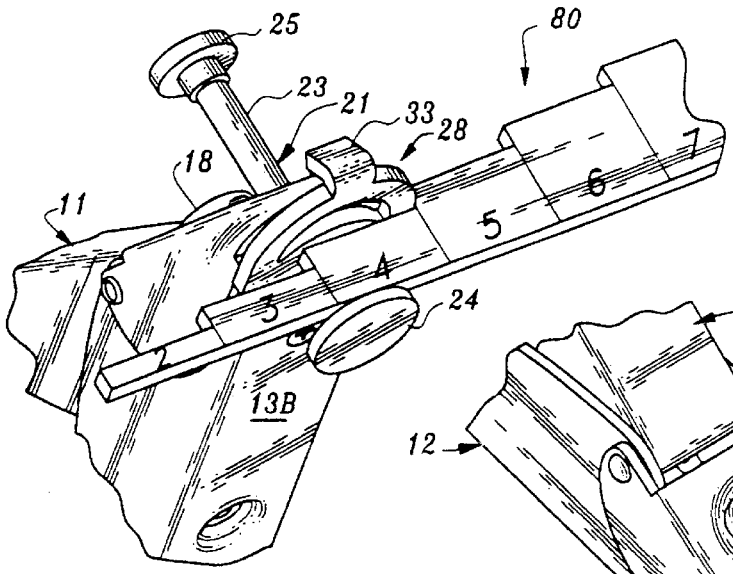
FIG. 17 is a front perspective view showing the sizing accessory being utilized.
Figure 18:
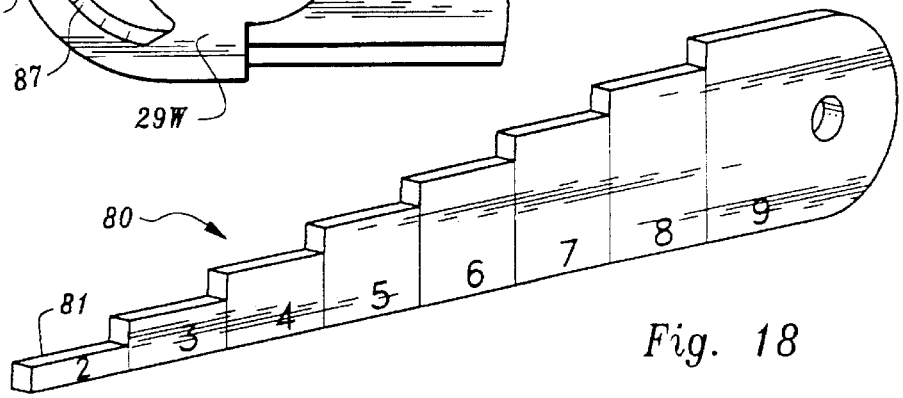
FIG. 18 is a front elevational view of a nail sizing tool accessory to be employed herewith.

The artificial nail trimmer of this invention is seen in whole or in part in all of the figures. FIG. 5 is a sectional view used to help explain the assembly of this tool. In FIGS. 17 and 18 the sizing tool for use herewith is shown and discussed.

Figure 3:
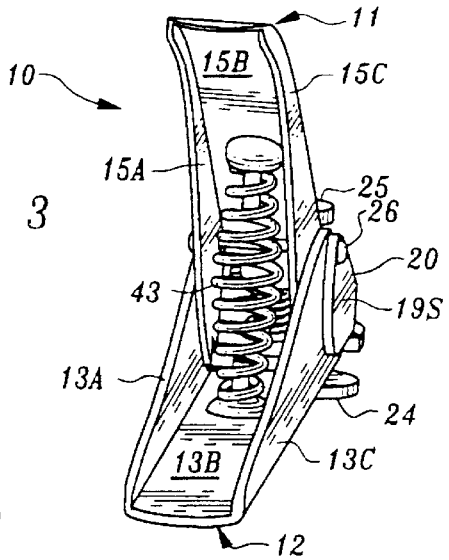
FIG. 3 is a rear perspective view thereof.
Figure 1:
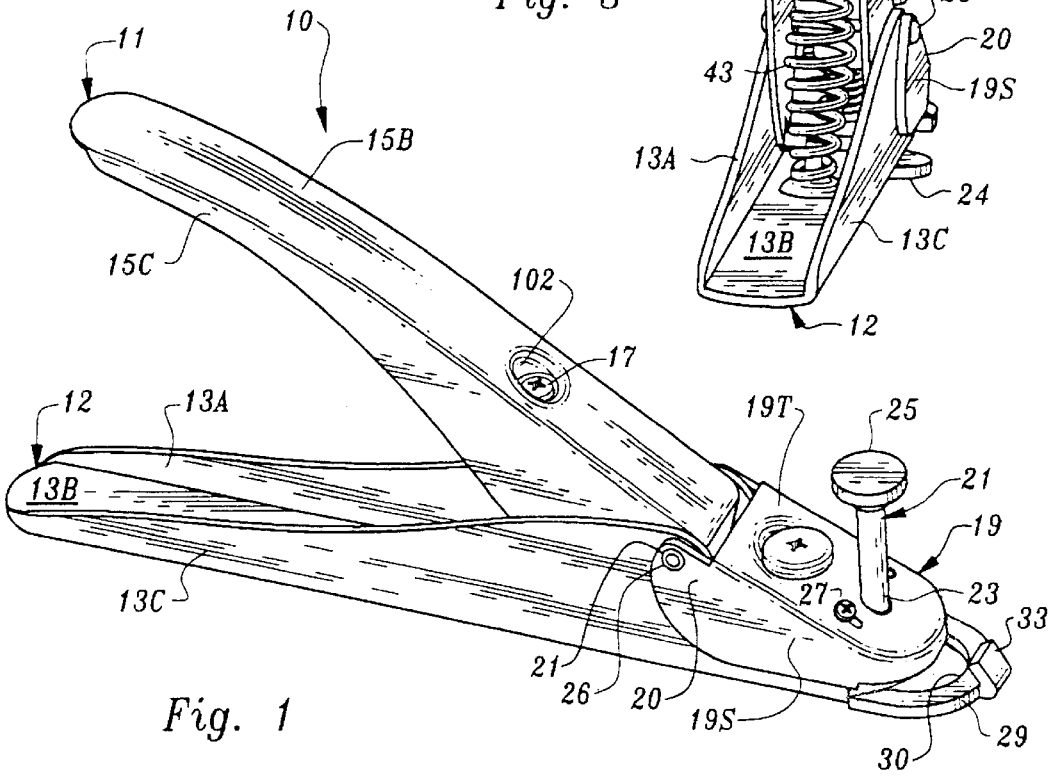
FIG. 1 is a top perspective view of the apparatus of this invention.
Figure 2:
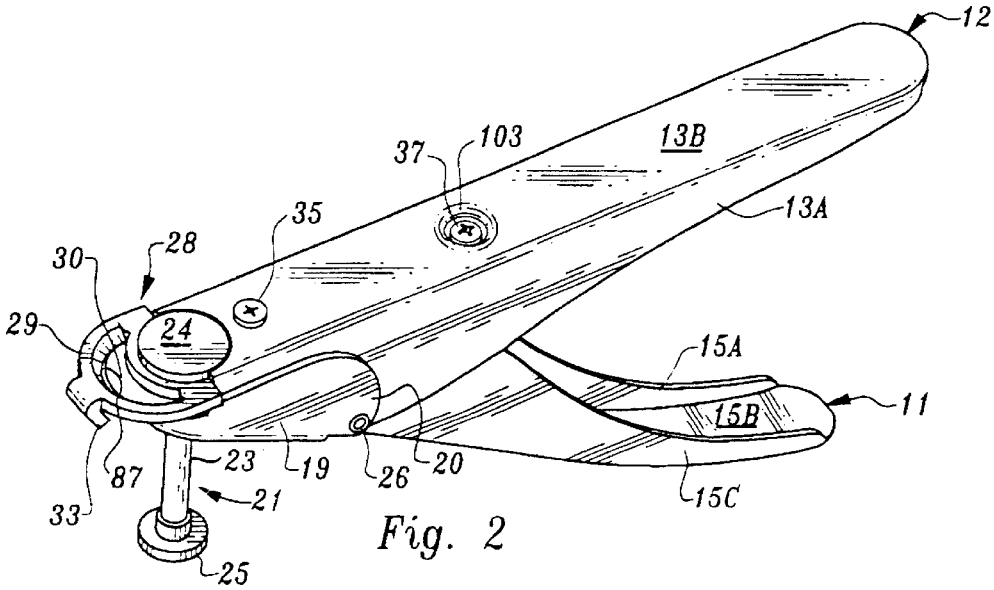
FIG. 2 is a bottom right side perspective view thereof.
Figure 6:
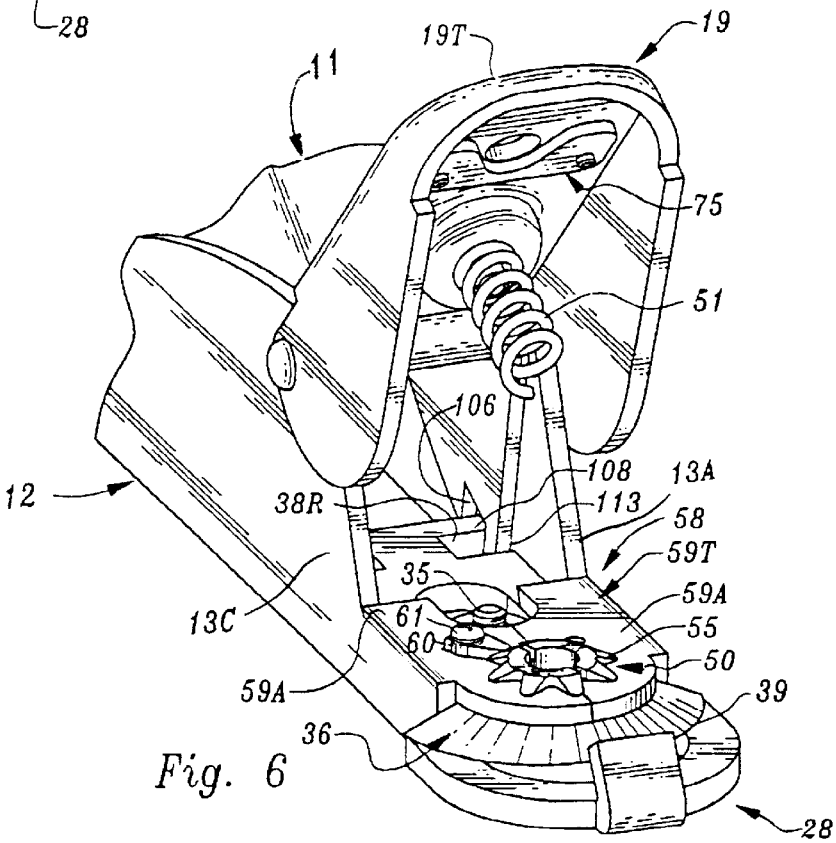
FIG. 6 is a close-up front perspective view of a portion of this invention.

The invention 10, as shown in FIGS. 1–3, has upper and lower handle portions 11, 12. The upper portion has a top wall 15B, and two parallel downwardly depending spaced sidewalls 15A, 15C; while the bottom portion 12 has a base wall 13B and two spaced upwardly depending sidewalls 13A, 13C. See also FIG. 3, the diameter of the base wall 13B is slightly greater than the diameter of top wall 15B such that when squeezed the two handles can move toward each other, whereby the upper handle portion 11 partially nests within the lower portion 12, when the two handle portions are squeezed. The sidewalls of both the upper and lower handle portions are tapered such that each is larger toward the front of the device as can be seen from FIG. 1 among others. The upper handle portion 11 terminates in its forward extension just past the pivot pin 26 which passes through the ears 20 overlying the lower handle portion 12. However, the extension of the of lower handle portion 12 is greater in that as per FIG. 2, the base 13B extends arcuately convexly just beyond assembly screw 35. In FIG. 6 the sidewalls 13A, 13C of the lower handle portion extend forwardly and inwardly to form a generally rectangular passage 58 in which a stationary nail holder 28 and a slidable blade 36 are retained. The top wall 59T of the passage 58 includes a pair of plates 59A.

In FIGS. 1 and 5 there is also seen set screw 17,which is retained by nut 101, which screw acts as the upper retainer for the coil spring 43 disposed thereon, which spring serves to return the two handles to their at rest spaced apart position. The lower end of the spring 43 is disposed upon set screw 37. The set screw 37 is retained by another nut 101. The head of screw 37 is seen in the bottom plan view FIG. 2 disposed in a recessed manner in recess 103 such that the head can sit flush with its surroundings.

Set screw 17 is inserted through aperture 110 beneath the recess 102 in the upper portion 15B and is threaded into nut 101. By preferably providing the recess 102 into which the head of the set screw can rest, and can be mounted flush with the surface of portion 15B, when threadedly engaged.

In order to achieve optimal operation, that is, contraction and elongation of the spring, it has been found that the angle of mounting of the upper set screw 17 should be about 105 degrees from the horizontal, while the lower set screw is optimally mounted at about 100 degrees from the horizontal as per FIG. 5.

Figure 20:
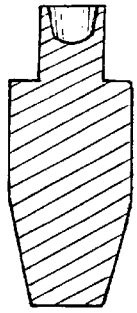
FIG. 20 is a sectional view of the rivet.

Note, the nuts 101 can be designed as rivets as per FIG. 20, as such the rivets can be engaged with the upper and lower handle portions needless the set screws 17 and 37. The rivets are inserted through the handle portions and are engaged by riveting on the ends of the rivets.

An inverted generally U-shaped jaw 19, per FIG. 1, is disposed forwardly of the upper handle portion, and is attached by pin 26 which can serve as a pivot pin through each of the bores 21, of the ear sections 20 at the rear of each of the sidewalls 19S of the U-shaped jaw 19. The two ear sections are those areas of 19S that are behind the top wall 19T. Note the pin 26 also passes through bores in the lower handle portion, such as the upper, lower handle portions and the jaw 19 are engaged together.

A retention screw 18, per FIG. 5 serves to receive and retain the upper end of spring 51, is threaded through bore 15 in the recess 190 of the top wall 19T.

Forward of retention screw 18 is the elevation setter 21 which has a shaft 23whose upper end is threaded and which is retained by a threaded nut 25. The base 24 of the elevation setter 21 is welded, brazed or otherwise attached to the shaft 23. The shaft 23 is disposed for vertical movement, within bore 31 of the reinforcing annulus bolt 50, per FIG. 5, which annulus bolt 50 has a gear top 55 as seen in closeup view 10B. Bolt 50 is positioned into place, through a bore 56 in the top wall 59T of the rectangular passage 58 as per FIGS. 5, 6 and 11, and it passes through a slot 38S of the blade 36. A threaded bore 32 in the frontal area 44A of the nail holder body 34 serves to receive the bolt 50 for retention. Thus the shaft 23 is slidable in the jaw 19 via aperture 16 and lower handle portion 12. See FIGS. 5 and 13.

As is also seen in FIG. 5, the shaft 23 also passes adjacent a knife edge 115, which serves to prevent movement of the shaft 23. The bolt 50, which has a bore 31, not only serves as a residence for shaft 23, but also serves to control the clearance of the moveable cutter assembly 36, which reciprocates during the cutting cycle. A set screw 35, inserted through bore 47 in the base 13B, which set screw is threadingly engaged with the nail holder 28 by threaded bore 48. This screw serves to retain the nail holder to the base 13B of the lower handle portion 12. The post of the screw 35 extends through washer 117 which itself is disposed in the slot 38S of the blade 36.

Figures 13, 14, 15:
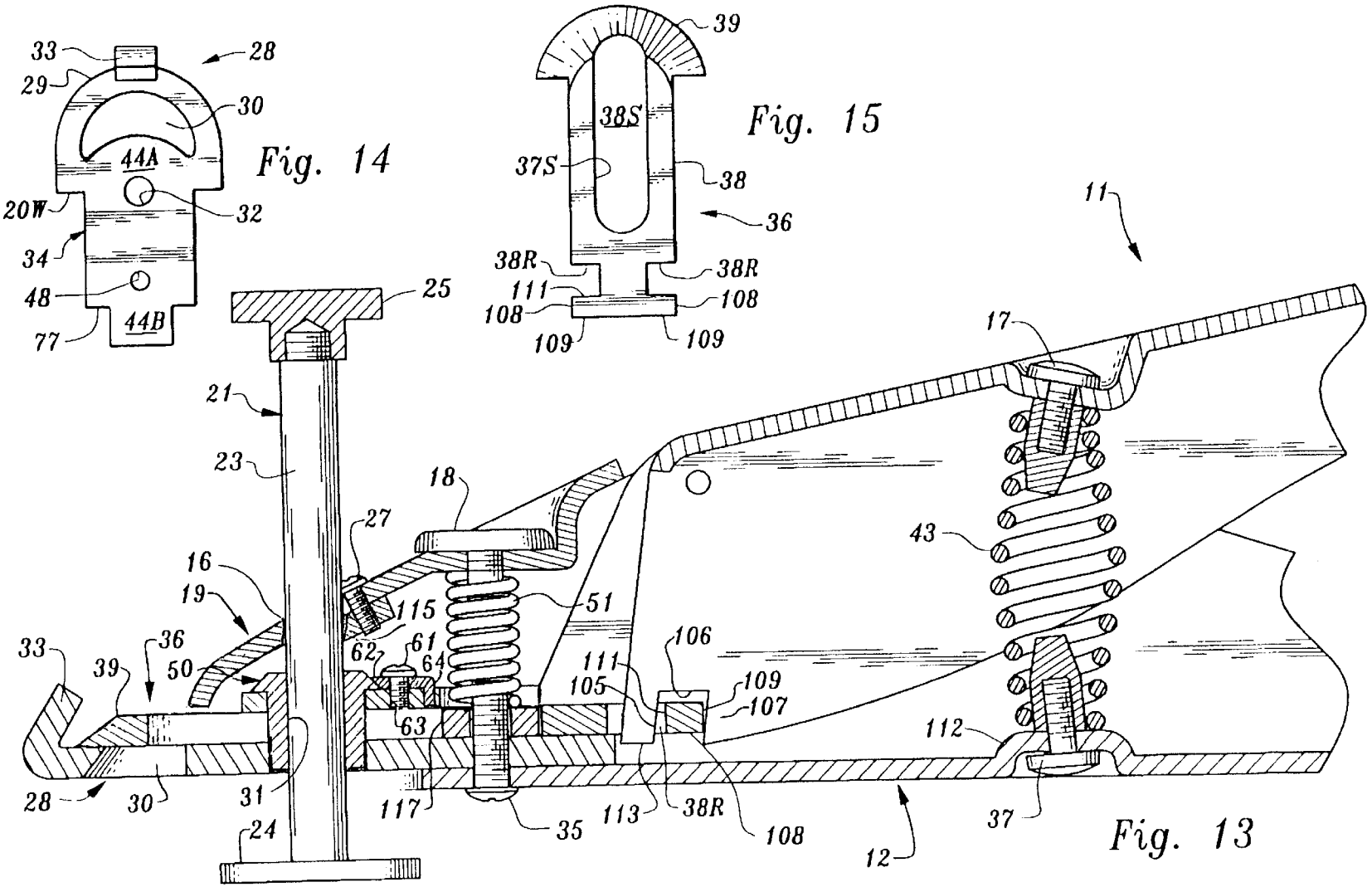
FIG. 13 is a section view of the apparatus of this invention at a point in time when the handle portions are squeezed, and showing the cutting assembly in forward movement.
FIG. 14 is a top plan view of the nail holder assembly utilized herein.
FIG. 15 is a top plan view of the cutter assembly utilized herein.

Since it was determined that the bolt 50 can easily come loose when the blade 36 slides forwardly or backwardly over the nail holder 28, due to the straight side 37S of slot 38S of the blade 36 being in contact with the bolt 50 during blade movement, the said tooth gear 55 was added as shown in FIGS. 11 and 15 to prevent rotation of the bolt 50 by engagement with gear lock washer 62 which has a front point 60 shaped like an arrowhead and a rear tail 64 per FIG. 9. The front point 60 of the gear lock washer 62 is engaged with the tooth gear 55 while the rear tail 64 is inserted through a bore 65 in the top wall 59T. Set screw 61 passes through the bore 66 in the gear lock washer 62 and engages the threaded bore 63 in top wall 59T per FIG. 11.

Thus it is seen that the tail 64 of the lock washer 62 and the post of the set screw 61 can not be extended over the thickness of the top wall 59T as per FIG. 13 such that the blade 36 can move. Set screw 61 serves to retain the washer 62 such that the tooth gear 55 can not move and therefore the bolt 50 can not rotate to become loosened.

The positioning of elevation setter 21 can be understood by reference to FIG. 5. Reference to other FIGURES is also encouraged. The elevation setter 21 is used exactly for the purpose for which this element is named. When a person inserts her nail, or artificial nail 95 into slot 30 (FIG. 12) from the underside of the apparatus, the tip 97 of the finger 96 for the nail to be cut is placed in contact with the base 24 of the elevation setter 21. See FIG. 12. This automatically determines the amount of nail to be trimmed. The more downwardly per directional arrow 98 the elevation setter 21 is positioned, the lesser the amount of nail will be trimmed by cutter blade edge 39.

The discussion now moves to the elevation setter 21. The shaft 23 thereof can be readily moved downwardly with a minimum of effort as FIG. 13. But attempts to raise the elevation setter 21 shaft 23 upon application of the same slight pressure fail. This is due to the construction of the apparatus.

Shaft 23 is frictionally retained in bore 31 of annular bolt 50 which passes through the nail holder unit 28. Shaft 23 also passes the knife edge 115 and passes through aperture 16.

As can be seen coil spring 51, which upper end is mounted on the post section of the retention screw 18 and lower end is disposed upon the on post set screw 35, exerts a force upwardly when it is relaxed, against the underside of the jaw 19. This pressure keeps knife edge 115 impinging against the shaft 23. A slight finger pressure on the head of the retention screw 18 is enough to move the knife edge downwardly just slightly, as spring 51 compresses a bit. This permits the elevation setter 21, to be raised back upwardly, as per FIG. 5.

The small coil spring 51's upper end is seen to be mounted on the post of the retention screw 18 as previously discussed. For best results it has been found that the angle of mounting of the retention screw 18 should be about 115 degrees from the horizontal.

Figure 16:
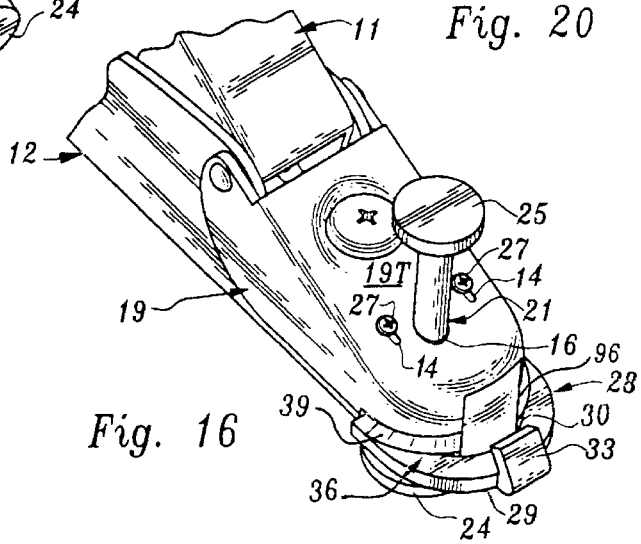
FIG. 16 is a top front perspective view showing the trimming of an artificial nail by the apparatus of this invention.

The reinforcement plate 75, shown in FIG. 8, is held in place by set screws 27 on the underside of the top wall 19T of the jaw 19 as per FIG. 6, has the preferably U-shaped knife edge 115 seen in FIG. 8, and was discussed previously. The knife edge is preferably U-shaped in order to provide as much surface area as possible in contact with the shaft 23. The set screws 27 whose head are best seen in FIG. 16 are inserted through the elongated bores 14 on opposite sides of the aperture 16 in the top wall 19T, and are threadingly engaged with the plate 75, in which are the threaded bores 76 per FIG. 5. These elongated bores permit the plate 75 to be adjusted forwardly such that the knife edge 115 always impinges against the shaft 23 to thereby keep the jaw closed in an accurate disposition.

Also seen in FIG. 1 and 2 among others is nail holder ring 29, having an internal slot 30 therein for receiving the nail to be cut. The nail holder ring 29 has an inwardly directed upstanding flange 33. This flange 33 prevents a cut nail, subsequent to cutting, from "flying" forwardly from the apparatus toward the lap of the customer. The flange, acts to inhibit such movement, such that the cut nail merely drops downwardly into a tray or onto the workstation of the manicurist.

In FIG. 2 as referenced infra is crescent 29. Crescent 29, also referred to as the nail holder ring, has a curved rearwardly and upwardly tapered inner edge 87 which may serve as a rest for the front of the artificial nail prior to trimming, as is demonstrated in FIG. 2. In FIG. 1, a top perspective view, edge taper can not be seen. The edge 87 permits the artificial nail to assume a position other than generally vertical for the trimming operation as desired for a visible feathered edge of the nail, by resting the nail against the tapered edge 87 per FIG. 12. For a straight cut, the nail 95 is placed in the slot 30 at an angle of 90 degrees from the horizontal, also seen in FIG. 12.

In FIG. 14, there is shown the nail holder 28 disassembled from any other elements of the apparatus. Thus it can be further seen that the holder ring 29 which is wider than the body to which it is attached, is in fact attached by wings 20W to the nail holder body 34's visible or main part 44A as seen from the top. Aperture 30 separates the crescent 29 from the main body adjacent the wings 20W. The balance of portion 44A and the remainder of the body 44B of a narrower width, is attached in the same plane at the rear of 44A which in point of fact is shaped like an arrowhead. The notches 77 that arise due to the difference in width of the two portions 44A and 44B of main body 34 are employed to permit the forward motion progress of the cutter assembly by enabling the pushers 107 seen in FIG. 13 to operate.

Figure 4A:
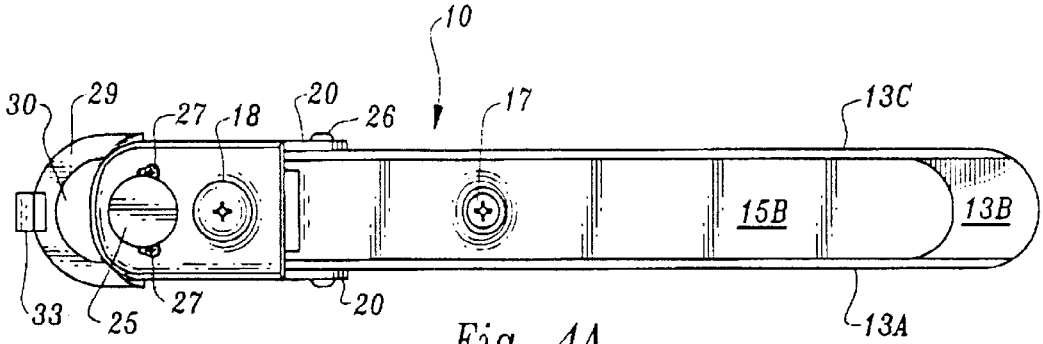
FIG. 4A/ is a top plan view with the blade recessed and the upper portion extended.
Figure 4B:
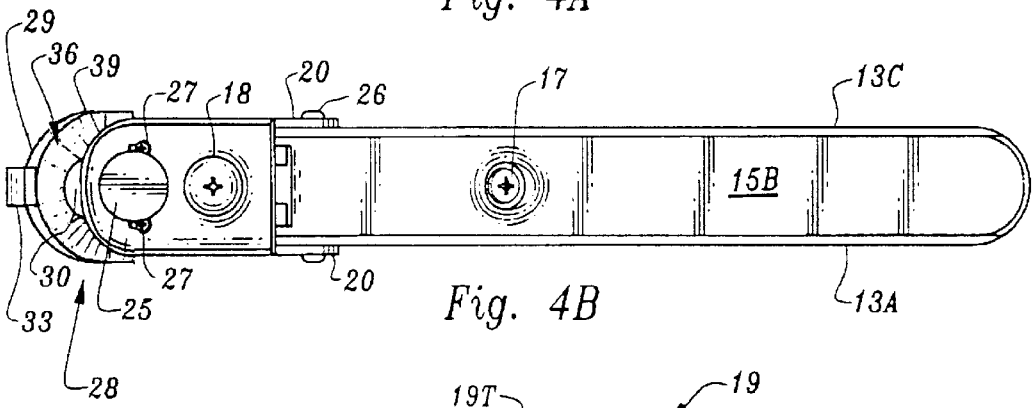
FIG. 4B is a top plan view with the blade extended and upper portion contracted.

In FIG. 4A, a top plan view of the device 10 of this invention, just prior to trimming a nail is seen. The point in time is confirmed by the fact that no part of the blade edge 39. And, both the upper handle portion and the lower handle portions are seen. However contrast FIG. 4A with FIG. 4B wherein the upper handle portion 11 has nested into the lower handle portion and section 13B is no longer visible. Note also movement forwardly of blade edge 39 is seen to have transpired. The blade edge 39 has been designed as a curved forward cutting edge whose diameter is slightly greater than the diameter of the curved aperture 30 of the nail holder, 28. Reference to FIG. 16 reveals the fact that the nail to be cut, will have the cut commence from the two edges of the nail inwardly toward the middle of the nail. This is due in part to the curvature of the artificial nail. Note the placement of the nail 96 in slot 30 in this FIGURE. By employing such a technique, a smooth cut of the nail can be easily had.

In FIG. 15, a non-assembled cutter assembly 36 is seen. Slot 38S is locus for the disposition of bolt 50 and washer 117 into which the post screw 35 seen in FIG. 11 is passed through. The slot 38S is needed to permit the cutter assembly to move forward with the bolt 50 and the washer 117 which is retained by the post screw 35 are imposition, such that the travel of the blade 36 during the cutting process is limited rearwardly by the presence of the bolt 50 and is limited forwardly by the presence of washer 117. The blade 36 also includes the notches 38R, in which serve as residences for noses 113 which have pulling edge 105.

The rear sections 108 of the cutter assembly 36 having front sides 11 and rear sides 109, are disposed in the notches 106 of the upper handle portion 11. It can be seen in FIGS. 5,7 that the cutter assembly has been designed for being pushed and pulled on both its right and left sides such that the cutter assembly always moves in a straight path.

As can be seen in FIG. 7, sidewall 15A shown partly in cutaway has a forward generally rectangular notched area. Sidewall 15C is a duplicate of side wall 15A and is spaced therefrom by the width of element 15B of the upper portion. The heretofore referenced notches 106 are at the front lower comer of each of 15A and 15C. The small areas of the sidewalls 15A, C that separate the leading edges of the sidewalls are designated the noses and bears reference numerals 113. The trailing edges 107, of the notches, which are generally parallel to the leading edges 105 of the notches. Note how the tails (rear sections) 108 of cutter assembly 36, are disposed in the notches 106 between the leading edges 105 of the noses 113 of the sidewalls and trailing edges 107 of the notches, 106.

Figure 19:
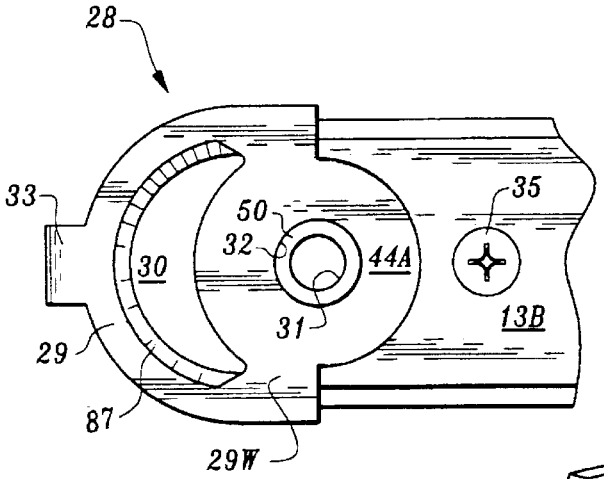
FIG. 19 is a close-up bottom plan view of a portion of the invention.

FIG. 19 is a bottom plan view with the elevation setter removed. The reinforcing annulus 50, which includes the aperture 31 wherein the elevation setter resides, is seen. In this figure also shows an area in which is a residence for the base 24 of the elevation setter 21 when the base 24 is raised upwardly and is in contact the nail holder 28, such that the base 24 can be flush with the base 13B of the lower handle portion as per FIG. 5.

SIZING TOOL

In FIG. 18, a sizing tool 80 is disclosed, which can be made of plastic or metal and which preferably should be employed with the apparatus of this invention when a preset length of nail to be worn is desired. This accessory is not necessary for the operation of the apparatus of this invention. This tool includes a series of steps 81 which has nine steps each corresponding to a preset uniform length increases of 1/10 inch elevation over the previous step. However millimeter increments can also be employed. The first step of the sizing tool is referenced as size 2 and the last step is size 9. Size 1 and size 10 have not been seen in this tool. It automatically has size 1 when the base 24 of the elevation setter is in contact with the nail holder 28, as per FIG. 5, and size 10 means the whole length of the nail. Thus, the nail wearer just needs to tell manicurist size number of nail to be worn, ten nails would be cut the same even length by using this tool in conjunction with the apparatus of this invention.

In FIG. 17 which shows the sizing tool it is disposed adjacent the elevation setter 21 of the apparatus of this invention. Size 4 is supposed for the desired size of the nail to be worn and the setting of the size has been accomplished. The next step is to remove the sizing tool off of the apparatus.

To set a size, one holds the device in the palm, with the thumb presses downwardly on the nut 25 per FIG. 13. The sizing tool is inserted between the base 24 and the nail holder 28. Pressure is applied by the thumb on the head of the set screw 18 while the index finger pushes the base 24 of the elevation setter upwardly until either side of the sizing tool is in contact with the base 24 and the nail holder FIG. 17. When the setting of a size has been accomplished the elevation setter can not move discussed previously and as such each nail inserted for trimming will be cut a finite uniform length.

Once the length has been set by the use of the sizing tool, in conjunction with the elevation setter 21, a nail such as 95 disposed on a person's finger can be positioned for trimming. The nail is inserted as shown in FIG. 12 into the nail holder unit 28's slot 30, and the base 24 of the setter 21 is in contact with the finger tip 97, a downward force is applied to the upper handle 11, the nail has been cut.

It is also to be seen that it is not necessary to use the sizing tool 80 of FIG. 18 shown in use in FIG. 17 in conjunction with this apparatus. Indeed, base 24 of the elevation setter may be urged maximally upward to its original position per FIG. 5 in the manner previously recited pertaining to the application of pressure on the retention screw 18; the nail is inserted into slot 30 as per the length desired, the thumb presses on the nut 25 of the elevation setter 21 until the base 24 is in contact with the tip 97 of the FIG. 96 as per FIG. 12. A special size of the nail to be worn has been set and the cutting operation begun.

OPERATION

In FIG. 7, note how the upper handle portion 11 connects to the cutter assembly 36. The noses 113 are inserted through the recesses 38R of the blade 36 and the tails 108 of the blade 36 are disposed into the notches 106, it can be seen in FIG. 6 and 13. When the upper handle portion 11 is squeezed with the lower portion 12, such that the upper portion pivots downwardly the trailing edges 107 of the notches 106 impact the rear sides 109 of the sections 108 of the cutter assembly 36 to help push the cutter assembly forward and the blade, edge 39 cuts nail which is inserted in slot 30. During this time the coil spring 43 is compressed as per FIG. 13. Upon release of the grip, the coil spring relaxes and the upper portion 11 returns from whence it came. The leading edges 105 of the noses urge front sides 111 of the sections 108 rearwardly and the cutter assembly moves back to its original position and the cut is completed.

When in the closed position the upper handle is at about a 33 degree position as opposed to the 45 degree at rest position. When squeezed, the lower handle retracts into the upper handle and the cutter assembly moves forward to make the cut.

CUTTER BLADE REPLACEMENT

From time to time it will be necessary to take the apparatus 10 apart to either or both clean the apparatus or to replace the cutter blade. In order to one or both of these operations, it is first necessary to remove the nut 25 from the elevation setter. Press the shaft 23 downwardly and remove it by pulling it out the bottom or underside of the apparatus. Open jaw 19 maximally. Remove the spring 51 and its washer 117. Next, remove screw 61 and lock washer 62. Undo bolt 50 (FIG. 6), and remove screw 35, (FIG. 2). Pull and remove the nail holder unit 28. Then squeeze the two handle portions to urge the blade forwardly for removal, and then remove.

Insert a new blade, relax the grip on the handles such that they can assume the at rest position. Reinsert nail holder 28, reapply screw 35, and bolt 50. As the bolt 50 is being threaded into position, one should squeeze and release the handle portions 11, 12, until blade 36 moves with ease. Reapply the lock washer 62 per FIG. 11 in correct alignment with gear 55. Reapply screw 61 through the washer 62 and tighten into place. Reapply washer 117 and the spring 51.

Close the jaw from the position in FIG. 6 to the position of FIG. 16. Make sure that the post of screw 18 and the post of screw 35 fit into spring 51 per FIG. 5. Using one's fingers to retain the jaw in the down position per FIG. 1, insert the shaft 23 of the elevation setter 21 upwardly through the aperture 31 in bolt 50 per FIG. 5. Re-thread the bolt 25 on to the shaft 23 to complete the re-assembly process.

It is to be understood that the leading and trailing edges of the notches of the upper handle are only engaged part of the time. Thus the blade can be removed when the handles are fully squeezed together, because due to the articulation of the upper handle, the leading edge of the notches rise out of engagement with the cutter assembly, to an above blade position, making for easy forward withdrawal.

It is seen that I have developed an improved nail trimmer designed especially for artificial nails. This apparatus can be set to cut a series of applied nails to a uniform length over the entire hand due to the presence of the elevation setter - a feature not found in other nail trimmers. This unit makes a round or straight cut most befitting an expensive artificial nail and thus avoids chipping and straggly cuts. The cutter assembly slides along the upper surface of the nail holder during the cutting operation, while the nail holder prevents the nail from being bent during the cutting operation thus ensuring a neat straight through arcuate cut. The cutter blade 36 moves from the rear of and above the slot 30, across the entire slot, and closes off the slot during the point of impact with the nail inserted in said slot.

The apparatus is preferably made of stainless steel for health and safety reasons. Of course, high impact plastic can also be employed for many of the components of this invention. Other metal may also be employed.

Since certain changes may be made in the described apparatus without departing from the scope of the invention herein involved, it is intended that all matter contained in the above description and shown in the accompanying drawings shall be interpreted as illustrative and not in a limiting sense.

I claim:

1. A fingernail trimmer for cutting a set of artificial nails while the nails are mounted on a human hand, all to the same length, which trimmer comprises:

upper and lower handles which are movable with respect to each other from a rest separated position to an in use closer disposed position, the upper handle having a reversible push means and pull means which engage with and cooperate to move a cutter assembly in opposite directions, said cutter assembly having a blade edge having a laterally curved forward cutting edge, a nail holder fixedly mounted to the lower handle and disposed forward thereof, said nail holder having a nail holder ring spaced from a nail holder body, by a curved slot for nail insertion, said movable blade edge being disposed slidably upon the nail holder, the cutting edge thereof being movable across and past the slot when relative movement is affected upon the cutter assembly by the push and pull means of the upper handle further including an upstanding flange on the nail holder ring to prevent deflection of the nail subsequent to cutting cycle.

2. The apparatus of claim 1 further including a separate sizer comprising an elongated member having a series of increased elevation steps correlated for the length of nail to be worn, said sizer adapted for insertion between the nail holder and the base of the elevation setter at any desired step, the desired step corresponding to the length of nail to be worn.

3. The apparatus of claim 1 wherein the upper and lower handles are pivotally mounted with respect to each other and wherein a coil spring is mounted between them, which spring is compressed upon the movement of one handle toward the other handle.

4. The apparatus of claim 1 wherein the nail holder ring has an interior curved edge that curves rearwardly and upwardly tapered inner edge which may serve as a rest for the front of the artificial nail prior to trimming.

5. The apparatus of claim 1 further including a pivotally openable jaw, with a frictionally vertically movable elevation setter therein, disposed through said nail holder body and adjacent to said curved slot for determining the length of nail to be worn.

6. The apparatus of claim 5 wherein the elevation setter comprises a movable shaft having a base on the lower end and a removable nut on the other end.

7. The apparatus of claim 6 wherein the elevation setter is frictionally retained in place from upward movement by a releaseable knife edge.

8. The apparatus of claim 5 wherein the elevation setter is disposed through said jaw and through a bolt having a throughbore, which bolt is threadingly engaged with said nail holder body.

9. The apparatus of claim 8, wherein the bolt having a throughbore has a top surface configured like a gear wheel suitable for engagement with a lockwasher for stationary retention thereof.

10. The apparatus of claim 5 further including a knife edge mounted to the underside of the jaw and which impinges upon the shaft of said elevation setter to inhibit movement of said shaft.

11. The apparatus of claim 1 wherein the cutter assembly is removably disposed in the forward end of the lower handle, which cutter assembly is engaged with the upper handle.

12. The apparatus of claim 11 wherein the push means and the pull means together comprise notches having leading edges and trailing edges, said notches overlaying and engaging a portion of said cutter assembly.

13. The apparatus of claim 12 wherein the cutter assembly has tails, which tails are the portions engaged by said notches.

14. The apparatus of claim 13 wherein the apparatus is made of stainless steel, or metal.

15. A fingernail trimmer for cutting a set of artificial nails while the nails are mounted on a human hand, all to the same length and shape, which trimmer comprises:

upper and lower handles which are movable with respect to each other from a rest separated position to an in use closer disposed position, the upper handle having a push means and pull means both of which cooperate to move a cutter assembly in opposite directions, said cutter assembly having a movable blade having a laterally curved forward cutting edge, a nail holder fixedly mounted to the lower handle and disposed forward thereof, said nail holder having a nail holder ring spaced from a nail holder body, by a curved slot for nail insertion, said nail holder ring, having an upstanding flange on the nail holder ring to prevent deflection of the nail during the cutting cycle;

a pivotally openable jaw, with a frictionally vertically movable elevation setter therein, disposed through said nail holder body and adjacent to said curved slot for determining the length of nail to be worn;

a knife edge compressed by a coil spring to impinge against said elevation setter to inhibit movement thereof;

said movable blade being disposed slidably upon the nail holder, the cutting edge thereof being movable across and past the slot when relative movement is affected upon the cutter assembly by the pushers of the upper handle.

16. The apparatus of claim 15 wherein the upper and lower handles are pivotally mounted with respect to each other and wherein a coil spring is mounted between them, which spring is compressed upon the movement of one handle toward the other handle and wherein the cutter assembly is removably disposed in the lower handle.

17. The apparatus of claim 15 wherein the push means and the pull means together comprise notches having leading edges and trailing edges, said notches overlaying and engaging portions of said cutter assembly said engaged portions being tails.

18. The apparatus of claim 15 wherein the nail holder ring has an interior curved edge that curves rearwardly and upwardly tapered inner edge which may serve as a rest for the front of the artificial nail prior to trimming.

* * * * *